United States Patent [19]

McLeod

[11] Patent Number: 4,704,598

[45] Date of Patent: Nov. 3, 1987

[54] NO OIL WARNING CIRCUIT

[75] Inventor: Kenneth M. McLeod, Lake Villa, Ill.

[73] Assignee: Outboard Marine Corporation, Waukegan, Ill.

[21] Appl. No.: 837,172

[22] Filed: Mar. 7, 1986

Related U.S. Application Data

[63] Continuation-in-part of Ser. No. 765,547, Aug. 14, 1985, abandoned.

[51] Int. Cl.[4] ..... G08B 21/00

[52] U.S. Cl. ..... 340/60; 340/52 F; 123/196 S; 123/198 D

[58] Field of Search ..... 340/60, 62, 52 F, 603, 340/59, 611; 123/196 S, 198 D

[56] References Cited

U.S. PATENT DOCUMENTS

| | | | |
|---|---|---|---|
| 2,582,483 | 1/1952 | Hallerberg | 340/60 |
| 2,715,723 | 8/1955 | Webster | 324/161 X |
| 3,723,964 | 3/1973 | Lace | 340/52 F |
| 4,021,794 | 5/1977 | Carlson | 340/60 X |
| 4,059,087 | 11/1977 | Tanigami et al. | 123/196 S |
| 4,369,743 | 1/1983 | Holt | 123/196 |
| 4,413,248 | 11/1983 | Staerzl | 340/52 F X |
| 4,445,470 | 5/1984 | Chmielewski | 123/196 |

*Primary Examiner*—Charles A. Ruehl
*Assistant Examiner*—Brian R. Tumm
*Attorney, Agent, or Firm*—Michael, Best & Friedrich

[57] ABSTRACT

An alarm system for a two-cycle internal combustion engine having a lubricating oil pump and an alternator generating electric pulses at a frequency related to engine speed. An integrated circuit configured as a counter has an input connected to receive the alternator pulses. A pressure switch generates an electric signal in response to the oil pressure increase in the pump output each time the pump operates. The integrated circuit has a first output which changes logic state in response to a predetermined count and has a second output which changes value at a frequency related to engine speed. The signal generated by the pressure switch is connected to a reset input to the integrated circuit so the counter is reset to zero in response to each oil pressure signal. An SCR switch controls operation of an alarm horn. A control connected to the integrated circuit and to the SCR operates the horn at a frequency related to engine speed. The control includes a flip-flop circuit connected to an IC output which changes logic at a given count. The control also includes a gate which is connected to a second IC output and is enabled by operation of the flip-flop. In one embodiment, the electric pulses, which are applied to the integrated circuit counter, are derived from pressure variations in fuel supplied to the engine by a fuel pump.

8 Claims, 2 Drawing Figures

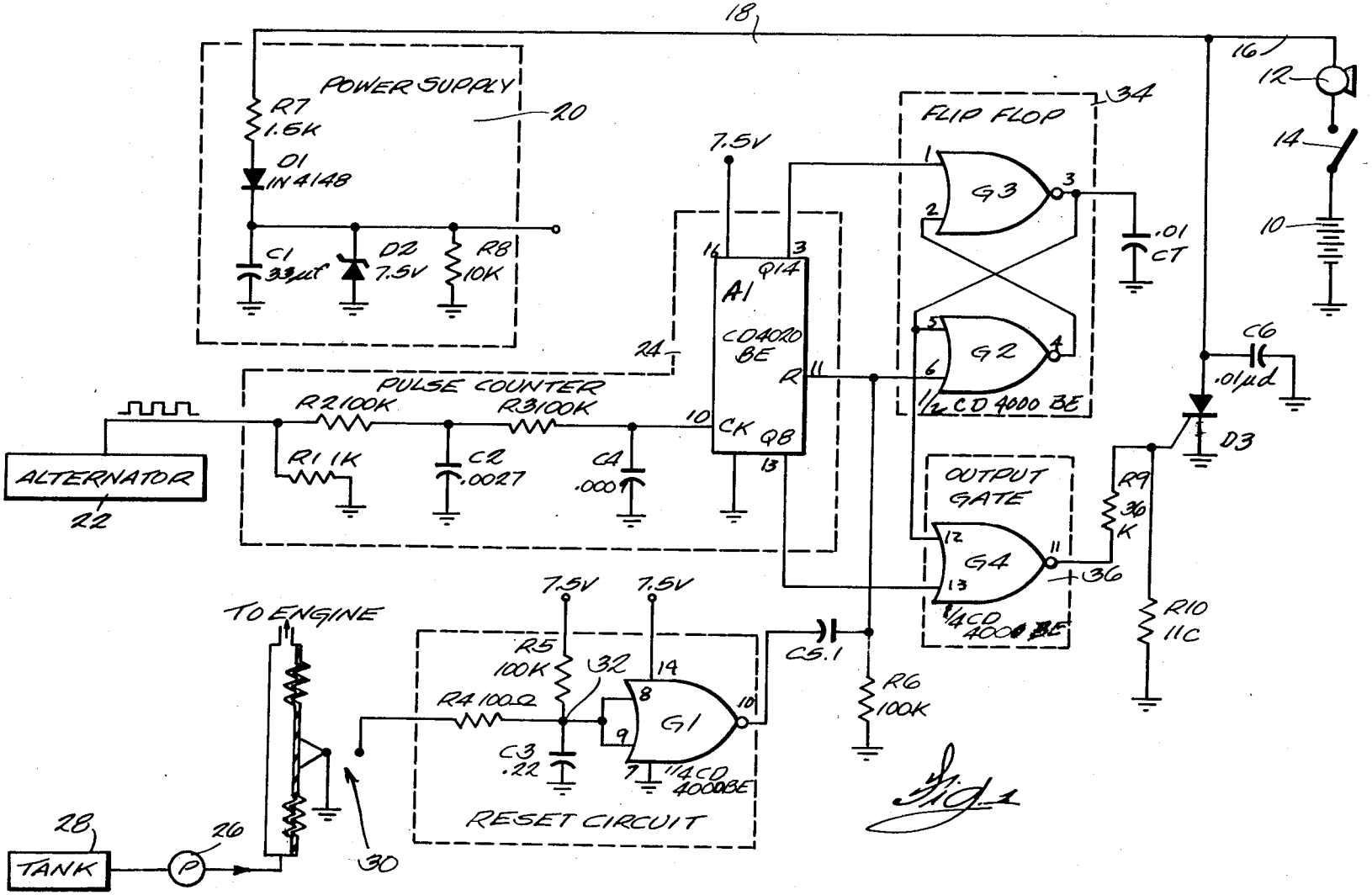
FLIP FLOP
OUTPUT GATE
POWER SUPPLY
PULSE COUNTER
RESET CIRCUIT
ALTERNATOR
TANK
TO ENGINE
7.5V
R10 11C
R9 36K
R6 100K
R7 1.5K
R8 10K
R3 100K
R2 100K
R1 1K
R5 100K
R4 100Ω
C3 .22
C4 .0001
C2 .0027
C6 .01μd
C5 .1
C1 33μf
D1 1N4148
D2 7.5V
D3
G1
G2
G3
G4
A1
CD4020 BE
1/2 CD 4000 BE
1/4 CD 4000 BE

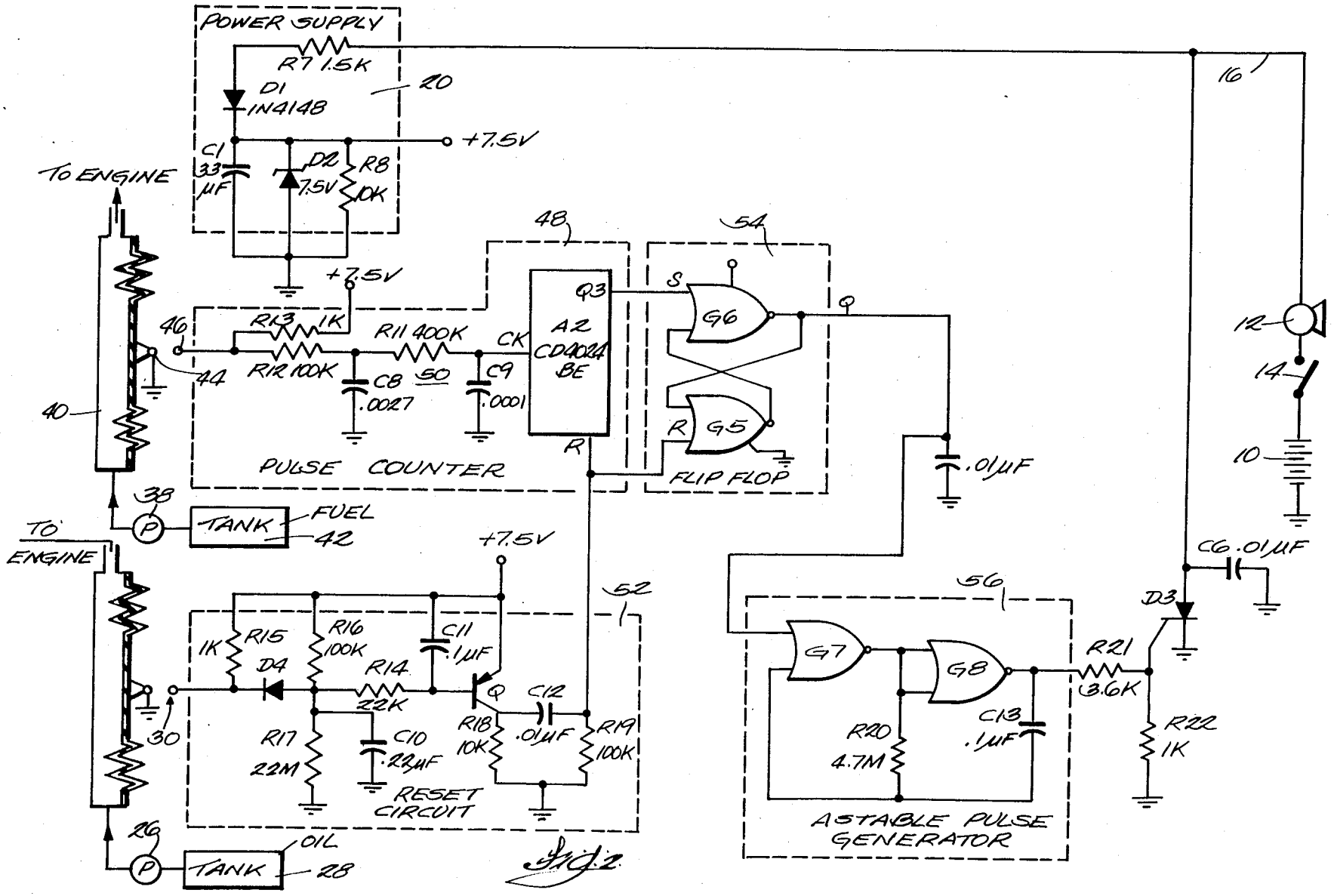
POWER SUPPLY
R7 1.5K
D1 1N4148
C1 33 μF
D2 7.5V
R8 10K
+7.5V
PULSE COUNTER
Q3
A2
CD4024 BE
CK
R
C9 .0001
R11 400K
C8 .0027
R13 1K
R12 100K
FLIP FLOP
G6
G5
S
R
Q
.01μF
ASTABLE PULSE GENERATOR
G8
G7
C13 .1μF
R20 4.7M
R21 3.6K
D3
C6 .01μF
R22 1K
RESET CIRCUIT
R19 100K
C12 .01μF
R18 10K
C11 .1μF
R14 22K
C10 .22μF
R16 100K
R15 1K
D4
R17 22M
FUEL TANK
OIL TANK
TO ENGINE
TO ENGINE

NO OIL WARNING CIRCUIT

BACKGROUND OF THE INVENTION

This is a continuation-in-part of now abandoned U.S. application Ser. No. 765,547, filed Aug. 14, 1985, now abandoned.

Two-cycle internal combustion engines customarily have oil mixed with the gasoline to lubricate the engine. The need for mixing the oil and gas can be avoided by providing the engine with an automatic oil injection system to inject oil directly into the engine from a reservoir. Such engines have been equipped with a low oil supply warning system to ensure the supply does not run out which would result in a seized or failed engine.

If the oil pump fails or there is a kink in the oil line or an air leak in the oil supply system, there can be a failure in the oil supply to the engine even though there is plenty of oil in the tank and the low oil warning has no need to operate. To avoid engine damage in such cases, systems have been provided to warn that no oil is being delivered to the engine. See, for example, U.S. Pat. Nos. 4,445,470 and 4,369,743.

The present invention provides a warning system in which the warning horn sounds at a frequency related to engine speed. Thus, at higher engine speeds where damage due to no oil happens faster, the horn is sounded more frequently which is more "alarming" to the listener. Put another way, the sound is perceived as more strident and commands attention.

SUMMARY OF THE INVENTION

This invention provides an alarm system for an internal combustion engine having an oil pump to provide lubricating oil to the engine. Electric pulses related in frequency to engine speed are generated. An electric signal is generated in response to actual pumping of oil by the pump. A counting device is connected to the pulse generator to count the pulses. The signal generator is connected to the counting device and each signal is operative to reset the counting device. A control responds to the counter reaching a predetermined count to cycle a horn on and off at a frequency directly related to the speed of the engine. Another feature of this invention is that the counting device is an integrated circuit having a first output which changes state at a predetermined count and a second output which goes between logic high and logic low at a frequency related to engine speed.

The alarm system described above includes an electronic switch operative when conductive to cause operation of the horn. An output gate is connected to and controls the switch. The output gate has first and second inputs. A flip-flop is connected to and operated by the first output of the integrated circuit and enables the gate in response to the change in state. The gate responds to the changing logic at the second output of the integrated circuit to operate the switch on and off.

A further feature of the invention is the provision of an alarm system for an internal combustion engine having an oil pump providing lubricating oil. An alternator driven by the engine generates electric pulses at a frequency related to engine speed. An integrated circuit counter is connected to receive the pulses. A device generates an electric signal in response to the oil pressure increase in the output of the pump each time the pump operates. The counter has a first output which changes state in response to a predetermined count and has a second output which changes value at a frequency related to engine speed. The signal generator is connected to the counter reset input so the counter is reset to zero each time the pump pumps oil. A switch controls operation of a horn. A control connected to the counter and the switch operates the horn at a frequency related to engine speed in response to the change of state at the first output and in response to the changing signal at the second output. Still another feature is that the control includes a flip-flop circuit connected to the first counter output and also includes a gate which is connected to the second counter output and is enabled by operation of said flip flop.

The invention also provides an alarm system for an internal combusion engine of the type having an oil pump for providing lubricating oil to the engine and having a fuel pump for providing fuel to the engine, the alarm system comprising fuel monitoring means for generating periodic electric pulses in response to pumping of fuel by the fuel pump, counting means coupled to the fuel monitoring means for counting the electrical pulses, means responsive to actual pumping of oil by the oil pump for periodically resetting the counting means in response to actual pumping of oil by the oil pump, a horn for producing an audible warning, and control means responsive to the counting means for actuating the horn to produce the audible warning in response to the counting means counting a predetermined number of the electric pulses.

BRIEF DESCRIPTION OF THE DRAWINGS

FIG. 1 is a schematic wiring diagram of one embodiment of the present warning system.

FIG. 2 is a schematic wiring diagram of another embodiment of the present warning system.

In the foregoing figures, as well as in the description which follows, various circuit components are identified by value or part number to facilitate understanding of the invention. It is to be understood however, that the invention is not limited in its application to the details of construction and the arrangements of components shown and described, as the invention is capable of other embodiments and of being practiced or being carried out in various ways. It is also to be understood that the phraseology and terminology used herein is for the purpose of description and should not be regarded as limiting.

DETAILED DESCRIPTION OF THE DRAWINGS

The positive side of battery 10 is connected to horn 12 through an ignition switch 14. Thus, when the ignition circuit for the engine is turned on, switch 14 is closed and the horn is now electrically "hot" so that lead 16 is provided with battery voltage. Until the present warning system operates, the horn will not sound since there is no low impedence path to ground through the horn and therefore there is not enough current through the horn to operate the horn. Lead 16 is connected to lead 18 which is connected to the power supply 20. The power supply is a conventional Zener power supply providing 7.5 volts to other points in the system as illustrated on the drawing.

This circuit is designed for use with a two-cycle internal combustion engine provided with an alternator depicted by box 22. The alternator output, insofar as relevant here, is a pulsed DC output which is applied to the pulse counter circuit 24 which includes an integrated circuit or chip A1 (CD4020BE) wired as a pulse counter (hereafter sometimes called an IC counter). Thus, the pulsed DC output from the alternator is applied to pin 10 which is the integrated circuit (IC) counter input. Typically, the alternator will provide 5 or 6 pulses for each revolution of the engine.

The chip A1 of the pulse counter 24 has a reset input (pin 11) and when a positive pulse is applied to the reset, the counter is reset to 0 and starts counting again. The reset signal is generated when there is actual oil delivery from the oil pump 26. Thus, pump 26 draws oil from the reservoir 28 and the pressure increase in the diaphragm chamber of the pressure switch 30 on the output of the pump during the pump stroke closes the switch 30 to ground junction 32 in the reset circuit through resistance R4. Any pressure switch construction can be used. Junction 32 normally has a positive charge by reason of its connection to the 7.5 volt power supply through R5. When the pressure switch closes, the junction 32 is connected to ground. This causes the inputs to the NOR gate G1 to go negative which causes the output of the gate to go positive which will then put a positive reset signal into pin 11 of the IC counter and will also apply a positive signal to pin 6 (the reset input) of gate G2 in the flip-flop circuit 34. Thus, every time there is a pressure wave in the oil delivery from the pump, the counter and the flip-flop are reset. If there is no such pressure wave (indicating a fault in the system), the counter is not reset and will continue counting the pulses from the alternator. At some predetermined count, a logic high or 1 signal is generated at the IC output Q14 and applied to terminal 1 of gate G3 of the flip-flop. This is the "set" gate. A logic high on the "set" input causes the flip-flop to output a logic low signal which is applied to pin 12 of output gate G4 to enable the output gate 36. The counter output Q8 (pin 13) alternately goes from logic high to logic low at a frequency related to engine speed.

An electronic switch in the form of SCR D3 controls the horn operation. When the SCR trigger is energized, the SCR conducts and provides a low impedance path from the battery through the horn to ground. The flip-flop 34 and output gate 36 comprise control means controlling the SCR trigger (and, therefore, the SCR) in response to signals from the integrated circuit. Thus, the control means responds to signals from Q14 and Q8. The signal from Q14 sets the flip-flop and enables the output gate 36. The alternate signals from Q8 then cause the gate to trigger the SCR at a frequency related to engine speed.

It will be noted that C1 provides power for circuit operation when the power supply in lead 18 is interrupted as it will be on a momentary basis when the horn 12 operates since this then will cause a rapid make-and-break of the switch within the horn. R8 provides a discharge path for C1 when the ignition switch is turned off so that if the ignition switch is turned back on, a proper reset voltage will be applied to counter chip A1 and flip-flop 34 to prevent the possibility of the horn sounding prematurely.

This obviates the need of another "hot" lead for power to the circuit. When power is first applied to the circuit, C3 is in a discharged state and, in charging through R5, holds the input voltage to gate G1 in a low state. This causes the output of gate G1 to be in a high state which, coupled through C5, provides a reset level to counter chip A1 and flip-flop 34. This insures that the horn will not be sounded when the ignition circuit is first turned on.

When the output gate 36 is enabled, the alternate high/low logic from Q8 is applied to pin 13 of G4 to cause the output gate to alternately drive the output SCR D3 on and off and this provides a low impedence path through the horn 12 and D3 to ground. Therefore, the horn will sound. The frequency of the horn on and off cycle is determined by the frequency of the alternator signal being supplied to the pulse counter. At idle conditions of the motor this frequency is low and at wide open throttle the frequency is high; thus providing a more rapid on/off cycle. This is perceived as a more alarming sound. Therefore, at higher engine speeds, (where lack of oil is more critical) the warning is more strident.

The output at Q8 is not the same as the frequency of the output from the alternator, but is directly related to it. Therefore, the pulsed operation of the SCR is also directly related to engine speed. The on/off time of the horn is 1280 divided by rpm. Thus, at 600 rpm the horn would be on for about 2 seconds and off from about 2 seconds, while at 6000 rpm the horn would be on for about 2/10 of a second and off for 2/10 of a second. That on/off frequency gets to be quite demanding and certainly gets the operator's attention. The short, rapid operation of the horn makes everything seem much more urgent.

In normal operation, i.e., with no loss of oil or no failure of the pump to deliver, the counter will not count long enough to cause the alarm beause it will be reset to 0 by the reset signal generated when oil is pumped and the oil switch closes. Thus, no alarm is sounded.

An alternate embodiment of the invention is illustrated in FIG. 2. In the description which follows, circuit elements, common to each of the embodiments shown in FIGS. 1 and 2, are identified by like reference numerals.

The warning circuit shown in FIG. 2 differs from that of FIG. 1 primarily with regard to the source of electric pulses which indicate that the engine is operating. In the circuit of FIG. 2, these pulses are derived, not from the engine alternator, but rather from pressure variations in fuel being supplied to the engine by an engine-driven fuel pump 38. To this end, fuel monitoring means are provided for generating periodic electric pulses in response to pumping of fuel by the fuel pump. Although various suitable means are available, in the embodiment illustrated, such means comprise a sensor 40 coupled to the output of fuel pump 38 which, in turn, is coupled to a fuel tank 42. When the engine is operating and fuel is being pumped by fuel pump 38, fuel pressure variations in the output of the fuel pump cause periodic closure of a pair of electrical contacts 44 and 46 actuated by sensor 40.

To monitor the occurrence of each closure of contacts 44 and 46, counting means are provided for counting the electrical pulses generated in response to actual engine operation. Various suitable means are available. In the illustrated embodiment, such means includes a pulse counter 48 having therein an IC counter A2 (CD4024BE). The clock input CK of IC counter A2 is coupled through a low-pass filter 50, comprising a resistor R11 and a pair of capacitors C8 and C9, and through a resistor R12, to sensor contact 46. The remaining sensor contact 44 is connected to circuit ground. To electrically bias contact 46 above ground potential, a pull-up resistor R13 is connected between contact 46 and the supply voltage provided by power supply 20. Closure of sensor contacts 44 and 46 causes the juncture of resistors R12 and R13 to be grounded, resulting in the application of a HIGH-LOW-HIGH logic transition on the IC counter clock input CK. Accordingly, the count in IC counter A2 is advanced upon each closure of sensor contacts 44 and 46.

To provide recurrent reset pulses for periodically resetting IC counter A2, means responsive to actual pumping of oil by the oil pump are provided for periodically resetting IC counter A2. While various suitable means are available, in the illustrated embodiment, such means includes a reset circuit 52 which responds to actual pumping of the engine oil during engine operation. A transistor Q, having its emitter connected to the DC supply voltage, and having its base coupled through a resistor R14 and diode D4 to the contacts of pressure switch 30, is biased into conduction upon each closure of the switch contacts. To this end, a pull-up resistor R15, connected between one contact of pressure switch 30 and the supply voltage is provided to bias the switch contact above circuit ground. Bias resistors R16 and R17, connected between the supply voltage and the anode of diode D4, and between the anode of diode D4 and circuit ground, respectively, bias transistor Q such that it remains non-conductive as long as the contacts of pressure switch 30 remain open. Upon closure of the switch contacts, the base of resistor Q1 is grounded through resistor R14 and diode D4, thereby rendering the transistor conductive. To prevent false triggering in the presence of electrical noise or other stray signals, by-pass capacitors C10 and C11 are provided.

To generate a logic pulse upon each closure of pressure switch 30, the collector of transistor Q is coupled through a resistor R18 to circuit ground. A serially connected capacitor C12 and resistor R19 are connected in parallel across R18. The reset pulse for application to IC counter A2 is derived at the juncture of capacitor C12 and resistor R19. When transistor Q1 is non-conductive, capacitor C12 is discharged and the reset pin of counter $A_2$ is held at circuit ground through resistor R19. When transistor Q1 is rendered conductive, the voltage at the juncture of capacitor C12 and resistor R19 initially increases, resulting in a LOW to HIGH logic transition on the reset input of counter A2. However, as capacitor C12 charges through resistor R19, the reset input of counter A2 undergoes a HIGH to LOW logic transition. It will thus be appreciated that a single reset pulse, having a constant duration determined by the charging time constant set by capacitor C12 and resistor R19, will be developed upon each closure of the contacts of pressure switch 30.

In order to provide an audible warning in the event oil is not being pumped during engine operation, control means are provided for actuating horn 12 when IC counter A2 counts a predetermined number of pulses applied to counter input CK. Although various suitable means are available, in the illustrated embodiment, such means comprises an RS flip-flop 54 and an astable pulse generator 56. As illustrated, a count-indicative signal, developed by counter A2, and the reset pulse, developed by reset circuit 52, are applied to the "set" (S) and "reset" (R) inputs, respectively, of RS flip-flop 54 which comprises NOR gates G5 and G6. In the embodiment shown, the Q3 output of counter A2, which undergoes a LOW to HIGH logic transition in response to the application of the fourth consecutive clock pulse following reset, is connected to the S input of flip-flop 54. Accordingly, flip-flop 54 will be "set" in response to four consecutive closures of switch contacts 44 and 46 without the intervening generation of a reset pulse by reset circuit 52. Although in the embodiment shown, four such switch closures are required in order to "set" flip-flop 54, it will be appreciated that the actual count required can be selected in accordance with actual operating requirements.

During normal engine operation, when both fuel and oil are being pumped, the periodic closure of the contacts of pressure sensor 30 results in the application of a series of reset pulses to counter A2. Counter A2 will ordinarily be reset prior to every fourth closure of switch contacts 44 and 46 and, accordingly, the count in counter $A_2$ will never reach Q3. Thus, during normal engine operation, flip-flop 54 will remain in a "reset" state and the output of gate G6 will remain logic HIGH. In the event of a failure in the oil supply system, the reset pulse will not be generated and the count in counter A2 will advance to Q3. Flip-flop 54 will then be "set" and the output of gate G6 will undergo a HIGH to LOW logic transition.

In the embodiment of FIG. 1, the frequency of the alternator pulses which were applied to the pulse counter 24 was sufficiently high as to produce an audible warning when used to periodically enable and disable warning horn 12. In the embodiment of FIG. 2 however, the frequency of the pressure variations in the output of fuel pump 38 is considerably lower and hence is not well-suited to the development of an audible warning. To provide for the development of such a warning, the embodiment shown in FIG. 2 includes an astable pulse generator 56 for periodically enabling and disabling the warning horn 12 at an audible frequency.

Pulse generator 56 comprises a pair of NOR gates G7 and G8 as shown. One input of gate G7 is connected to the output of flip-flop gate G6 while the remaining input is coupled through a capacitor C13 to the output of gate G8. The output of gate G7 is connected to both inputs of gate G8 and is also coupled through a resistor R20 to the remaining input of gate G7.

When the output of flip-flop gate G6 is logic HIGH, pulse generator 56 is biased into a stable mode and no logic transitions occur at the output of gate G8. When the output of flip-flop gate G6 is LOW, as it will be when the count in counter A2 advances to Q3, pulse generator 56 is biased into an astable mode and the output of gate G8 undergoes HIGH to LOW to HIGH logic transitions at a rate determined primarily by the time constant set by capacitor C13 and R20. These logic transitions are coupled through a resistor R21 to the control electrode of SCR D3 to bias the SCR D3 on and off at the astable pulse rate. Horn 12 is, thus, rapidly switched on and off with the result that an audible warning is developed. An additional resistor R22, connected between the control gate of SCR D3 and circuit ground, functions to assure that SCR D3 remains off when astable pulse generator 56 is biased into the stable mode.

Like the embodiment of FIG. 1, the embodiment shown in FIG. 2 requires that oil actually be pumped by oil pump 26 in order that generation of the audible warning be avoided. This, in turn, requires that the contacts of sensor 30 periodically open and close during engine operation. In the event of a malfunction which results in the contacts remaining either continuously open or continuously closed, the audible warning will be generated to alert the operator.

I claim:

1. An alarm system for an internal combustion engine of the type having an oil pump for providing lubricating oil to the engine and having a fuel pump for providing fuel to the engine, said alarm system comprising fuel monitoring means for generating periodic electric pulses in response to pumping of fuel by the fuel pump, counting means coupled to said fuel monitoring means for counting said electrical pulses, means responsive to actual pumping of oil by the oil pump for periodically resetting said counting means in response to actual pumping of oil by the oil pump, a horn for producing an audible warning, and control means responsive to said counting means for actuating said horn to produce the audible warning in response to said counting means counting a predetermined number of said electric pulses.

2. An alarm system in accordance with claim 1 wherein said counting means includes an integrated circuit counter having a clock input for receiving the electric pulses, a reset input for setting said integrated circuit counter to a reset condition in response to application of a reset voltage on said reset input, and a count-indicative output for providing a logic transition in response to application of a pre-determined number of the electric pulses to said clock input following application of the reset voltage to said reset input.

3. An alarm system in accordance with claim 2 wherein said control means includes a flip-flop which has two stable states and which is conditioned from one to the other of said stable states in response to the occurrence of said logic transition at said count-indicative output.

4. An alarm system in accordance with claim 3 wherein said control means further comprises an astable generator for providing a plurality of sequential logic transitions in response to said change of state of said flip-flop.

5. An alarm system in accordance with claim 4 wherein said control means further comprises a silicon controlled rectifier operable in response to said plurality of sequential logic transitions for periodically enabling and disabling said horn in synchrony with said sequential logic transitions.

6. An alarm system in accordance with claim 5 wherein said fuel monitoring means includes a sensor coupled to the output of the fuel pump and having a pair of electrical contacts which are periodically opened and closed in response to actual pumping of fuel by the fuel pump.

7. An alarm system in accordance with claim 1 wehrein said fuel monitoring means includes a sensor coupled to the output of the fuel pump and having a pair of electrical contracts which are periodically opened and closed in response to actual pumping of fuel by the fuel pump.

8. An alarm system in accordance with claim 1 wherein said reset means periodically resets said counting means prior to the completion of the consecutive generation of a series of said electric pulses equal in number to said predetermined number.

* * * * *